US006736204B2

(12) United States Patent
Gollan et al.

(10) Patent No.: US 6,736,204 B2
(45) Date of Patent: May 18, 2004

(54) HEAT TRANSFER SURFACE WITH A MICROSTRUCTURE OF PROJECTIONS GALVANIZED ONTO IT

(75) Inventors: Dieter Gollan, Markranstädt/Seebenisch (DE); Jovan Mitrovic, Paderborn (DE); Andreas Schulz, Quedlinburg (DE); Helmut Pietsch, Quedlinburg (DE)

(73) Assignee: SDK-Technik GmbH (DE)

( * ) Notice: Subject to any disclaimer, the term of this patent is extended or adjusted under 35 U.S.C. 154(b) by 0 days.

(21) Appl. No.: 10/305,569

(22) Filed: Nov. 27, 2002

(65) Prior Publication Data

US 2003/0136547 A1 Jul. 24, 2003

(30) Foreign Application Priority Data

Dec. 6, 2001 (DE) ..... 101 59 860

(51) Int. Cl.[7] ..... F28F 7/00

(52) U.S. Cl. ..... 165/185; 165/905; 165/133; 361/704; 361/703; 361/707

(58) Field of Search ..... 165/133, 185, 165/905, 104.33, 80.3, 166, 104.21; 361/676–724; 257/706–776; 174/16.3; 29/890.03

(56) References Cited

U.S. PATENT DOCUMENTS

| | | | | |
|---|---|---|---|---|
| 3,842,474 A | * | 10/1974 | Schladitz | 29/890.03 |
| 4,129,181 A | | 12/1978 | Janowski et al. | 165/133 |
| 4,219,078 A | | 8/1980 | Withers, Jr. | 165/133 |
| 4,246,057 A | | 1/1981 | Janowski et al. | 156/150 |
| 4,254,431 A | * | 3/1981 | Babuka et al. | 257/713 |
| 4,288,897 A | | 9/1981 | Withers, Jr. | 29/157.4 |
| 4,577,381 A | | 3/1986 | Sato et al. | 29/157.4 |
| 5,821,624 A | * | 10/1998 | Pasch | 257/776 |
| 6,124,631 A | * | 9/2000 | Cardot et al. | 257/667 |
| 6,125,043 A | * | 9/2000 | Hauer et al. | 361/760 |
| 6,153,940 A | * | 11/2000 | Zakel et al. | 257/779 |
| 6,211,571 B1 | * | 4/2001 | Zakel et al. | 257/780 |

FOREIGN PATENT DOCUMENTS

| | | | |
|---|---|---|---|
| DE | 27 58 526 | 7/1979 | B21B/19/12 |
| DE | 197 57 526 | 4/1999 | B21C/37/20 |
| EP | 0 057 941 | 8/1982 | F28F/13/18 |
| EP | 0 713 072 | 5/1996 | F28F/13/18 |

* cited by examiner

*Primary Examiner*—Terrell McKinnon
(74) *Attorney, Agent, or Firm*—Renner, Kenner, Greive, Bobak, Taylor & Weber

(57) ABSTRACT

This invention relates to a heat transfer surface (3) or tubular or plate-like bodies (4) having a microstructure (7) projecting out of the base surface (3*a*) and consisting of projections (6) which are galvanized onto the base surface (3) with a minimum height of 10 $\mu$m.

The object of this invention is to create a heat transfer surface (3) of this type which is characterized by an increase in thermal efficiency of its heat transfer surfaces (3) with the smallest possible temperature differences and is suitable for both nucleate boiling and film condensation with a justifiable manufacturing expense.

The object is achieved according to this invention by the fact that the base surface (3*a*) is covered entirely or partially with projections (6); these projections (6) are applied in the form of ordered microstructures (7) and they have a pin shape, extending with their longitudinal axis (6*c*) either at a right angle to the base surface (3*a*) or at an angle ($\alpha$) between 30° and 90°.

17 Claims, 7 Drawing Sheets

HEAT TRANSFER SURFACE WITH A MICROSTRUCTURE OF PROJECTIONS GALVANIZED ONTO IT

BACKGROUND OF THE INVENTION

This invention relates to a heat transfer surface on tubular or plate-like bodies having a microstructure of projections protruding out of the base surface, the microstructure being galvanized onto the base surface with a minimum height of 10 $\mu$m, as well as a method of producing such heat transfer surfaces.

According to the state of the art, heat transfer surfaces are used in a variety of shapes and sizes in evaporators and condensers. Their structural design will depend on the type of evaporation (convective evaporation, nucleate boiling or film evaporation) and condensation (dropwise or film condensation).

The area of nucleate boiling is of the greatest importance. The formation of vapor bubbles takes place on the heat transfer surfaces. The growth, size and number of bubbles per unit of heat transfer surface and time are determined by essentially three parameters:

a) the properties of the boiling liquid, b) the material of the heating wall as well as the structure of the heating surface, c) the heat flow density.

In order for vapor bubbles to be able to develop and grow in a liquid, certain physical conditions must be met. The model concepts for describing these conditions are usually based on homogeneous nucleation, which in turn is usually attributed to fluctuations in density. Once it has formed, a vapor bubble requires an environment that allows it to grow. A simple equilibrium analysis yields the following relationship in evaporation:

$$T - T\infty = \frac{2\sigma T\infty}{\Delta h \varsigma v r} \quad \text{(equation I)}$$

where:

r=bubble radius,

σ=surface tension of the liquid,

Δh=enthalpy of evaporation,

δv=vapor density,

T=temperature of the liquid,

T∞=the equilibrium temperature at a planar phase boundary.

The temperature difference T−T∞ may thus be interpreted as the minimum required overheating of the boiling liquid at the prevailing bubble size having radius r. It may be reduced by the fact that bubbles of large dimensions—i.e., with a large r—are produced through suitable measures. The heating heat transfer surface plays a central role. A favorable design of this heat transfer surface can greatly increase the efficiency of heat transport in boiling. The goal here is to achieve a heat transfer surface having a microstructure, which leads to the highest possible bubble density with a large bubble radius at the smallest possible temperature difference. This is a prerequisite for efficient heat transfer from the heat transfer surface to the liquid.

Essentially microstructures having cavities which are not flooded by the surrounding liquid after the bubbles break away are essentially suitable for this purpose. Vapor bubbles formed in the cavities expand during the growth phase into the liquid adjacent to the heat transfer surface and break way from this heat transfer surface when a system-dependent critical variable is exceeded; this takes place in such a manner that vapor residues remain in the cavities and serve as nucleation seeds for subsequent bubbles.

In the area of condensation, we encounter essentially film condensation and heat transfer devices, where the primary purpose is to keep the thicker condensate film away from the cooling heat transfer surface, which should also be provided with suitable microstructures. The driving force for the runoff of condensate can be linked to the capillary pressure $$\Delta p = \frac{2\sigma}{r} \quad \text{(equation II)}$$

where σ is the surface tension and r is the radius of curvature of the phase boundary.

U.S. Pat. Nos. 4,288,897, 4,129,181 and 4,246,057 have disclosed microstructures as heat transfer surfaces on tubular bodies, where smooth tubes are wrapped with layers of polyurethane foam with a thickness of approximately 0.00025" to 0.0025" (approximately 6.35 $\mu$m to 63.5 $\mu$m), their open pore structures first being metal plated in a chemical process. Then the tube is connected to the metal-plated polyurethane sheathing as the cathode and to the base surface of the tube as the anode, and the galvanic deposition is begun. The electrolyte penetrates through the foam to the cylindrical surface of the tube, permitting a uniform deposition of metal ions on the tube and also in the interior of the foam structure. After achieving a suitable layer thickness, the galvanic process is terminated and the foam material is removed by burn-off (pyrolysis, leaving a porous metallic structure that is highly cross-linked and intermeshed on the base surface. It contains completely irregular thicknesses of the webs and completely different cavities and thus completely irregular, unordered structures, leaving the formation of vapor bubbles, e.g., in evaporation, up to chance. In cooling, impurities in the coolant remaining behind in the microfine cavities can have an extremely negative effect on the heat transfer.

U.S. Pat. No. 4,219,078 discloses a heat transfer surface in which a porous film to be wrapped around a tube contains copper particles with a diameter of 0.1 mm to 0.5 mm which are applied to the base surface in multiple layers and are joined by a galvanic process to an entire surface structure. Although this surface structure has a certain regularity, this cannot conceal the fact that bubbling is hindered more than promoted by the multilayered nature of the particles. The numerous cavities also counteract good heat transfer efficiency with regard to film condensation.

To make heat transfer surfaces porous and thus provide them with a certain uniformity in ordered structure with regard to their surface, non-generic mechanical machining processes are often used, such as those disclosed in German Patent 197 57 526 C1, U.S. Pat. No. 4,577,381, German Patent 27 58 526 A1 and European Patent 0 713 072.

Thus, for example, the tubes disclosed in German Patent 197 57 526 C1 and in European Patent 0 057 941 are worked with special rolling and upsetting tools to achieve a special, very rough, knurled surface structure. However, this surface structure is not in the micro range but instead is in the millimeter range, the thickness of the ribs being approximately 0.1 mm and their pitch approximately 0.41 mm with a tube diameter of 35 mm, which does not correspond to the generic microstructure. Although the channel-like cavities beneath the base surface can promote the development of bubbles in evaporation, they counteract the goal of keeping the cooling surfaces free in film condensation. The same thing is also true of the objects of the other publications cited above.

In addition to this previously known state of the art, there are also a number of types of coating by means of a sintering technique, a sprayer technique, flame spraying and sandblasting. None of these are generic methods and none of them attempt to solve the problem on which the present invention is based.

BRIEF SUMMARY OF THE INVENTION

The object of this invention is to create a heat transfer surface of the generic type defined in the preamble as well as a method for producing such a heat transfer surface, which is characterized by an increase in the heat transfer efficiency of its heat transfer surfaces at the lowest possible temperature differences $T-T\infty$ and an optimum thermal efficiency and is suitable for nucleate boiling as well as film condensation at a justifiable manufacturing cost.

This complex object is achieved with regard to the heat transfer surface in combination with the above-mentioned generic term by the fact that the base surface is entirely or partially covered with projections; these projections are applied in the form of ordered microstructures and they have a pin shape, their longitudinal axis running either perpendicular or at an angle between 30° and 90° to the base surface. This feature creates for the first time a heat transfer surface in the microstructure range whose projections are shaped like pins and extend with their longitudinal axis perpendicular or transversely to the base surface. Therefore, vapor bubbles can lead to unhindered development of bubbles having large dimensions in the microareas between these structures and can develop at the minimum required overheating of the boiling liquid at a temperature difference $T-T\infty$, so that after they break way, new vapor bubbles can form as nuclei and expand in the open cavities, thus ensuring not only a high bubble density but also a high bubble frequency.

Furthermore, the cavities that are completely open to the outside and also between the individual pin-shaped projections may guarantee an excellent film condensation, so that the film can always flow away unhindered and uniformly in all directions. Therefore, an excellent thermal efficiency and an usually high heat transport of heat transfer surfaces designed in this way can be ensured. The heat transfer surface according to this invention also allows variations in the surface density and thickness of the pin-shaped projections, depending on the viscosity of the liquid applied to them, namely between $10^2/cm^2$ and $10^8/cm^2$ at a thickness between 100 $\mu$m and 0.2 $\mu$m. The great porosity of this microstructure has a significant positive effect on the heat transfer process in nucleate boiling.

Also in the area of condensation, a heat transfer surface is now created which ensures a good effect of the surface tension $\sigma$ and promotes heat transport. To achieve a high uniformity of the heat transfer efficiency, it is advantageous to keep a constant length of the pin shape on one and the same heat transfer surface. This length of the pin shape may be between 10 $\mu$m and 195 $\mu$m, depending on the size and specific function of the heat transfer surface.

It may also be advantageous for the outside configuration of the pin shape on one and the same heat transfer surface to be the same. The thickness of the pin shape may be between 0.2 $\mu$m and 100 $\mu$m.

Furthermore, it is advantageous to make the clearance between the pin-shaped projections one and the same heat transfer surface regular. This clearance may be between 0.6 $\mu$m and 1,000 $\mu$m, depending on the desired heat transfer surface and the liquid acting on it.

In the specific embodiment of the pin-shaped projections, this invention also allows numerous embodiments.

For example, according to a first embodiment, the pin-shaped projections are in the shape of a cylindrical column. According to a second embodiment, the pin-shaped projections are designed as cones or truncated cones. According to a third embodiment, the pin-shaped projections may consist of several truncated cones stacked together.

According to a fourth embodiment, the pin-shaped projections are provided with a cylindrical stand whose free end has a mushroom shape.

And finally—although not exclusively, the pin-shaped projections form a cylindrical stand, whose free end is provided with a spherical shape or a partially spherical shape.

Because of this microstructure, the pin-shaped projections can be applied to practically any plate-like or tubular bodies or similar bodies. However, tubular bodies should have an inside diameter or an outside diameter of at least 2 mm.

The heat transfer surfaces described above are produced according to a method for producing a heat transfer surface on tubular or plate-like bodies with a microstructure which protrudes above the base surface, having a minimum height of 10 □m of projections galvanized onto it, whereby the base surface is covered with a plastic film and galvanized, as described in U.S. Pat. Nos. 4,288,897, 4,129,181, 4,246,057 and 4,219,078.

In terms of the process technology, the object of this invention is achieved in combination with the aforementioned definition of the generic species by the fact that a polymer membrane which is provided with micropores is applied as a plastic film, so that it covers the entire surface of the base surface, and then in the subsequent galvanization process the body carrying the base surface is wired to function as one of the electrodes, and after reaching the desired length and shape of the pin-shaped projections which form the micropores, the galvanization process is interrupted, and then the polymer membrane is removed.

Due to the shape, the thickness of the polymer membrane, the size and distribution of the micropores in this membrane with regard to their surface density as well as the duration of the galvanization process, it is possible to define the pin-shaped projections which are described above and which in their entirety form the ordered microstructure on the base surface of the heat transfer surface, depending on the requirements of the heat transfer process with regard to the specific properties of the liquid (viscosity, thermal conductivity, surface tension) to meet the needs of the given evaporation or condensation process.

In an especially advantageous refinement of this invention, an ion track membrane, also known as a nuclear trace filter, is used as the membrane, where the micropores in the membrane are formed by ion bombardment and by subsequent etching operation using a base such as an alkaline solution of NaOH.

After conclusion of the galvanization process, i.e., after the final formation of the desired shape and length of the pin-shaped projections, the membrane is stripped off, thereby exposing the entire heat transfer surface.

BRIEF DESCRIPTION OF THE DRAWING

Several exemplary embodiments of this invention will now be described on the basis of the drawings, which show.

DETAILED DESCRIPTION OF THE INVENTION

Figure 1:
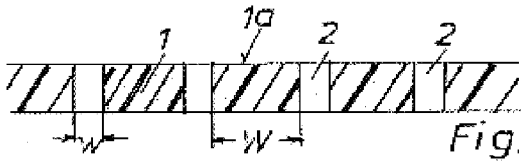
FIG. 1*a* sectional view through the ion track film with continuous micropores after the bombardment and etching process, FIG. 2*a* top view of FIG. 1, FIG. 3*a* cross section through a body after applying the ion track membrane from FIG. 1, FIG. 4*a* top view of FIG. 3, FIG. 5*a* cross section through FIG. 3 after the start of galvanic deposition with the formation of the pin-shaped projections in the micropores, FIG. 6*a* top view of FIG. 5, FIG. 7*a* cross section through FIG. 5 after a lengthy galvanization process and the formation of hemispheres and mushroom shapes at the end of the pin-shaped projections, FIG. 8*a* top view of FIG. 7, FIG. 9*a* cross section through a body having the pin-shaped projections projecting out of its base surface, after stripping off the ion track film, FIG. 10 the top view of FIG. 9, FIG. 11 a top view of FIG. 7 after stripping off the ion track film, FIG. 12 a top view of FIG. 11, FIG. 13 the surface-covering wrapping of a tubular body with an etched ion track membrane, FIG. 14 a perspective top view of a plate-like body having pin-shaped projections protruding out of its base surface in the form of several truncated cones stacked together, FIG. 14*a* a perspective top view of a plate-like body having pin-shaped projections in the form of cylinders protruding at a right angle out of its base surface, FIG. 14*b* a perspective top view of a plate-like body having pin-shaped projections in the form of cylinders protruding out of its base surface at an angle of approximately 60□, FIG. 15 a perspective view of a cylindrical tube having a microstructure applied as the base surface to its outside cylindrical surface.
Figure 2:
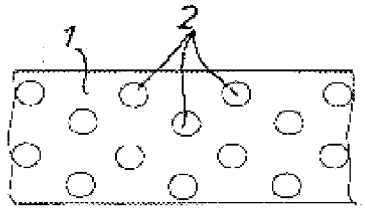

According to FIGS. 1 and 2, first a polymer film 1 is bombarded with fast, heavy ions whose energy may amount to several MeV/nucleon. The penetrating ions leave behind an altered structure of the polymer film, the so-called latent ion track (track) in their area of influence. This structure shows an increased reactivity with respect to alkaline solutions such as an NaOH solution. If a polymer film irradiated in this way is exposed to the action of an alkaline solution, the solution will penetrate into the polymer film along the track at a certain rate, while the penetration of solution into the polymer film 1 advances more slowly by several orders of magnitude at the unirradiated surface 1*a*. The movement of the alkaline solution along the ion track causes an etching process which leads to the formation of micropores 2 in polymer film 1, the thickness of which may be between 0.2 $\mu$m and 100 $\mu$m, depending on the etching regimen selected.

Figure 3:
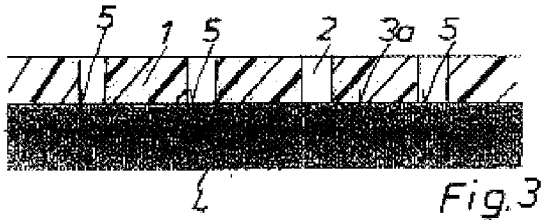
Figure 4:
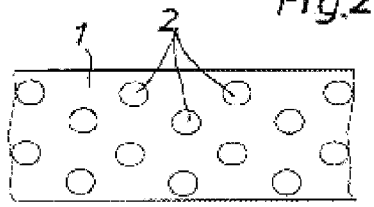

The ion track membrane 1 prepared in this way is applied over the entire area or just a part of a heat transfer surface as the base surface 3*a* of a tubular or plate-like body 4 according to FIGS. 3 and 4.

Figure 5:
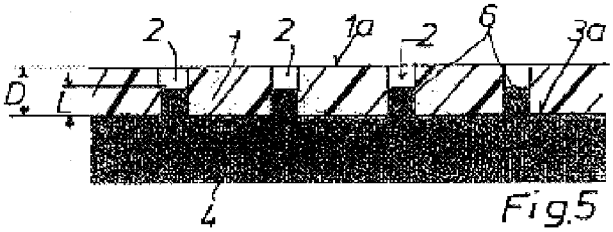
Figure 6:
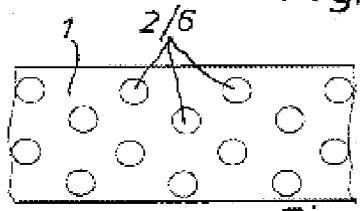

Then according to FIGS. 5 and 6 the tubular or plate-like body body 4 provided with the ion track membrane 1 is treated galvanically according to FIGS. 5 and 6 by connecting the body 4 which carries the base surface 3*a* to function as one of the electrodes. The galvanic deposition then takes place first on the entire surface wetted by electrolyte. After a relatively short period of time, which depends essentially on the roughness of the ion track membrane 1, this galvanic deposition is limited only two the surface areas 5 which are left free by the micropores 2 (see FIG. 3).

Therefore, pin-shaped projections 6 as visible in FIGS. 5 and 6 are formed in the micropores 2.

The shape of the resulting pin-shaped projections 6 of microstructure 7 (see FIG. 14) depends on the shape of the micropores 2, their mutual arrangement and also to a significant extent the duration of the gravitation process. A short galvanization process leads to pin-shaped projection 6 whose length L is smaller than the thickness D of the polymer film formed by the ion track membrane 1, as shown in FIG. 5.

In a lengthy galvanization process, the tips of these pin-shaped projections 6 reach the surface 6*a* of the ion track membrane 1, where they can continue to develop freely, usually in the form of spheres, hemispheres or cups or mushrooms 8. This is illustrated in FIGS. 7 and 8.

Figure 9:
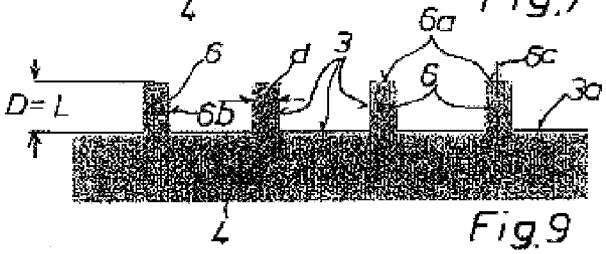
Figure 10:
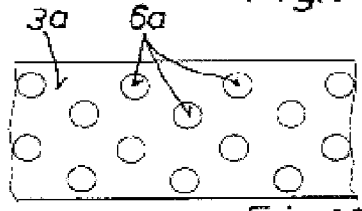

If the galvanization process is terminated promptly, the tips 6*a* may reach the surface 1*a* of ion track 1 and then have a length L which corresponds to the thickness D of the ion track membrane 1. This is illustrated in FIGS. 9 and 10 in conjunction with FIG. 5.

Figure 7:
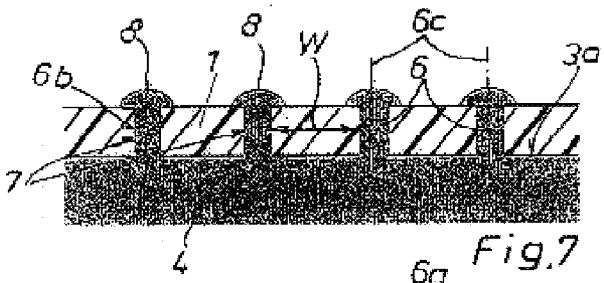
Figure 8:
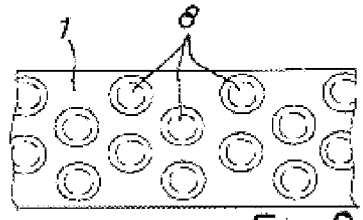
Figure 11:
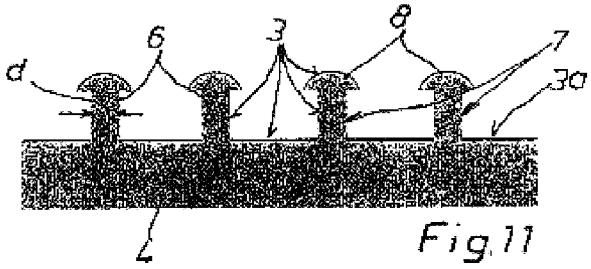
Figure 12:
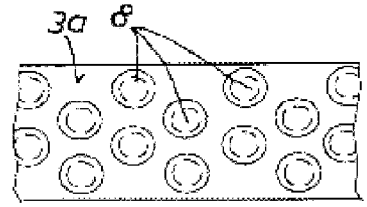

After stripping the ion track membrane 2 from FIG. 7, result is a base body 4 according to FIGS. 11 and 12 with pin-shaped projections 6 which cover its base surface 3*a* and whose free end has a mushroom-shaped head 8. This stripping or etching away of the ion track membrane 2 takes place after conclusion of the galvanization process, which exposes the metallic microstructure 7 (see FIGS. 9 and 11).

Figure 13:
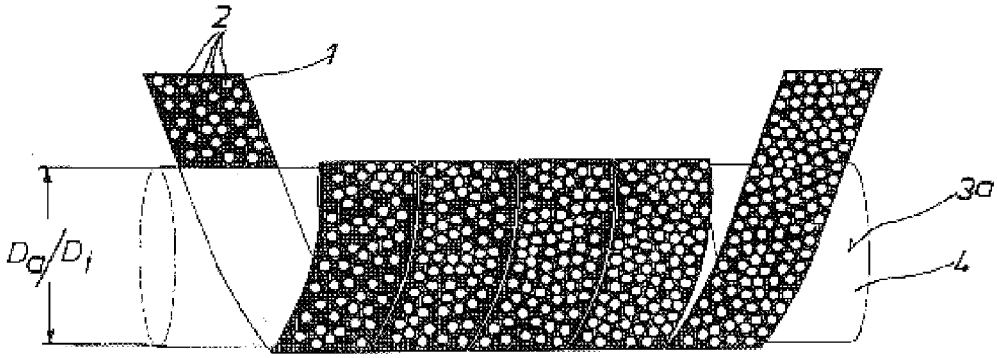

FIG. 13 illustrates the wrapping of a tubular body 4 with an ion track membrane 1 in the form of strips in which are formed open micropores 2 by means of an etching process.

Figure 14:
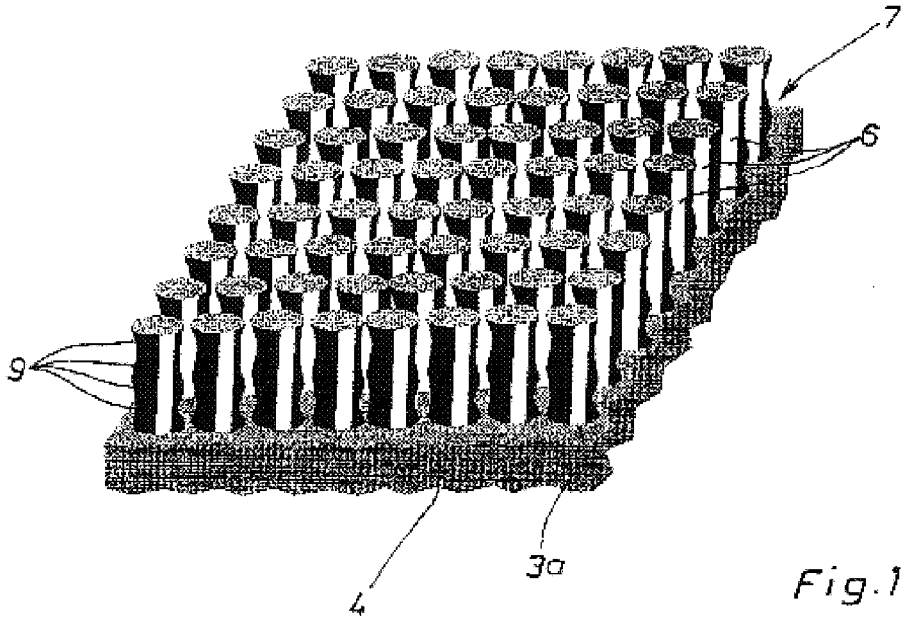

FIG. 14 shows a microstructure 7 of pin-shaped projections 6 on a plate-like body 4, the projections being composed of several partial sections 9 in the form of truncated cones which protrude at a right angle out of the base surface 3*a*.

Figure 14A:
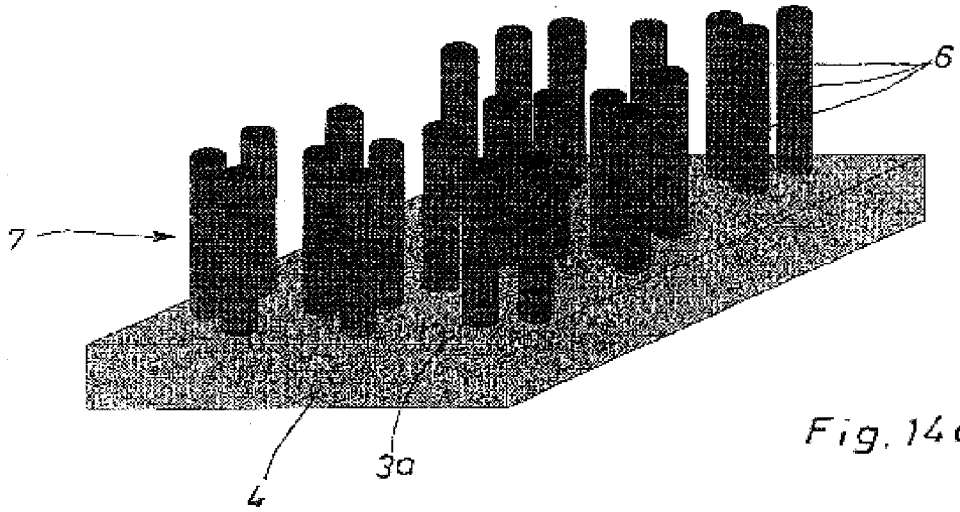

FIG. 14*a* shows a perspective top view of a plate-like body 4 with a microstructure 7 of pin-shaped projections 6 in the form of cylinders which protrude a right angle out of the base surface 3*a*. This microstructure 7 corresponds to that described in conjunction with FIGS. 9 and 10.

Figure 14B:
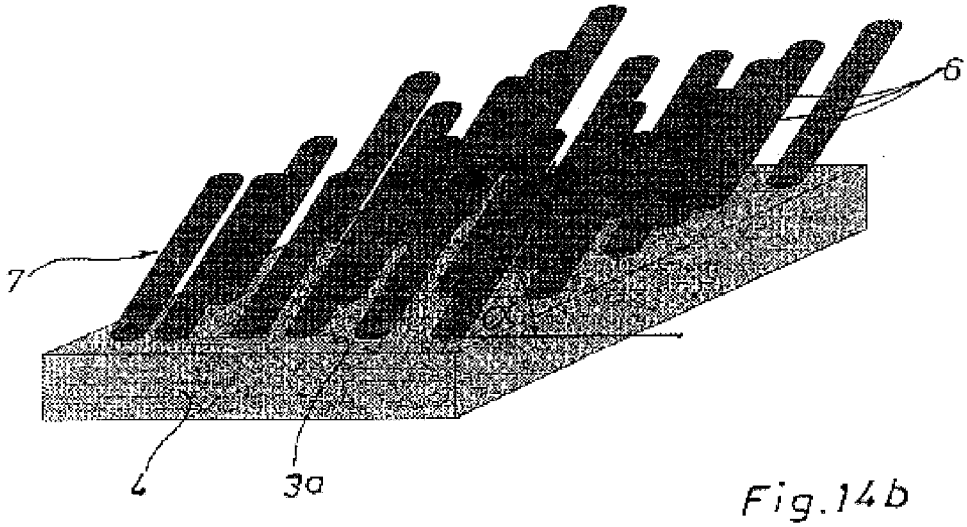

FIG. 14*b* shows a plate-like body 4 with a microstructure 7 of pin-shaped projections 6 protruding out of the base surface 3*a* and inclined to it at an angle of $\alpha$ of 60°.

After stripping off the ion track membrane, a microstructure 7 appears, depending on the shape and height of the micropores 2 and the duration of the galvanization process, the pin-shaped projections 6 of this microstructure having a cylindrical shape (e.g., according to FIGS. 5 and 9) or a mushroom shape (see FIGS. 7 and 11) or a conical shape or the shape of a truncated cone or a plurality of truncated cones 9 stacked together according to FIG. 14. On their free ends the pin-shaped projections 6 may also be provided with a hemispherical, spherical or cup-shaped head.

The tubular body 4 according to FIG. 13 should have an outside diameter or an inside diameter $D_a$, $D_i$ of at least 2 mm to permit such a microstructure 7. The thickness d (see FIG. 9) of the pin-shaped projections 6 depends essentially on the width w (see FIG. 1) the micropores 2. This intentionally refers to "thickness" and "width" instead of diameter, because a diameter always indicates the diameter of a circle, which in the present case is true only to a limited extent because of the roughness of the pin-shaped projections on their outside surface 6*b*. The micropores 2 also by no means have a circular shape, contrary to how they are depicted in the drawings.

Since the length L of the projections 6 is subject to the same galvanization process and thus the same galvanization time, it is essentially constant on one and the same base surface 3*a*. The length L of the pin-shaped projections 6 may be between 10 $\mu$m and 195 $\mu$m, depending on the size and specific function of the heat transfer surface 3.

The thickness d (see FIGS. 9 and 11) may be between 100 $\mu$m and 0.2 $\mu$m, so that a number of pin-shaped projections 6 from $10^2/cm^2$ to $10^8/cm^2$ may develop per unit of area accordingly. It is also essential to this invention that the pin-shaped projections 6 extend with their longitudinal axis 6*c* (see FIGS. 7 and 9) approximately perpendicular to base surface 3*a* or at an angle between 30° and 90°.

The clearance W between the pin-shaped projections 6 according to FIGS. 1 and 7 is to be distinguished from the width w of micropores 2. This clearance W is between 0.6 $\mu$m and 1,000 $\mu$m, depending on the desired heat transfer surface 3.

Depending on the duration of the galvanization process, the thickness D of the ion track membrane 1, the width w of micropores 2 and the clearance W between micropores 2 and thus the pin-shaped projections 6, the result is a heat transfer surface which has a microstructure 7 and is especially suitable for use as a heat transfer surface 3 in phase transition processes. It should be pointed out here that the original base surface 3*a* is greatly enlarged by the additional surface area of the pin-shaped projections 6. For this reason, the heat transfer surface 3 is not understood to refer to the base surface 3*a* of the tubular or plate-like body 4 but instead it refers to the entire heat transfer surface, i.e., including the total surface area of microstructure 7.

Figures 15, 16:
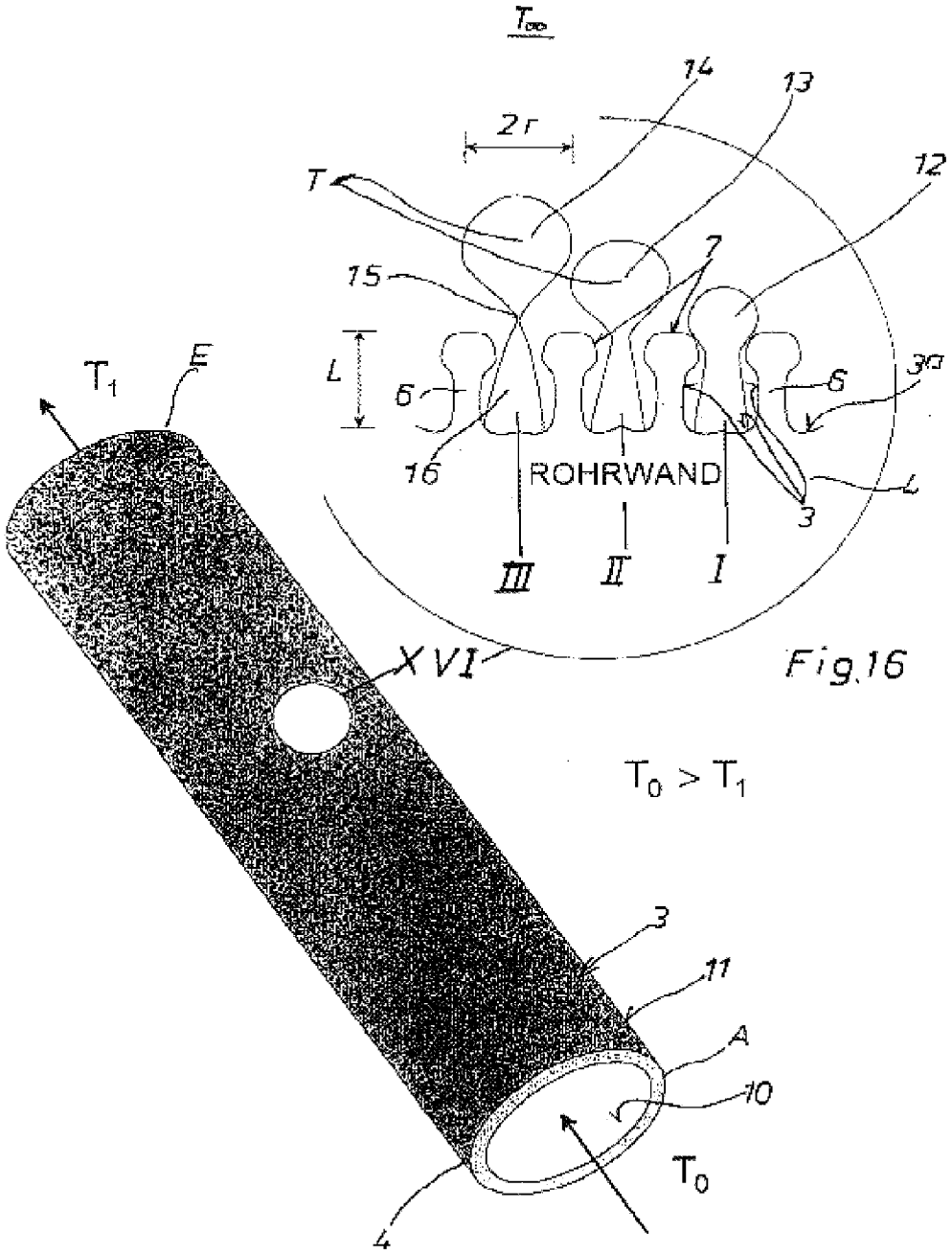
FIG. 16 a detail enlargement XVI from FIG. 15 showing three different phases in the development of bubbles, FIG. 17 the perspective photographic view of a partial detail of a body with an applied microstructure in the form of pin-shaped projections.

To illustrate the mechanism of action of this heat transfer surface 3, reference is made below to FIGS. 15 and 16. The tubular body 4 has a hot liquid going through it on its inside 10 for example, this hot liquid being cooled from an inlet temperature $T_0$ to an outlet temperature $T_1$ from the beginning A of body 4 the end E. The outside 11 of tubular body 4 which is provided with a microstructure 7 and pin-shaped projections 6 is to be exposed to a liquid, for example. The projections 6 of microstructure 7 of a mushroom shape according to FIG. 16. According to phase I, a bubble begins to form near base surface 3*a*, growing as it rises with the temperature difference $T_0-T_1$, passing through the clearance W between two projections 6 where it forms a small bubble 12. In phase II this bubble 12 has grown to a moderately large bubble 13. In phase III, bubble 14 has a large radius r and breaks away a short time later at location 15. Since a nucleus 16 always remains between the pin-shaped projections 6, the interspace between the pin-shaped projections 6 cannot be flooded by liquid. This nucleus 16 leads to the development of a new bubble 12 according to phase I. Bubble radius r according to phase III may be between 2 $\mu$m and 10 $\mu$m, when the clearance W between the pin-shaped projections 6 and their length L is designed accordingly, for example (see also FIGS. 7 and 9).

Since there is a dependence between the minimum required overheating $T-T\infty$ of the boiling liquid on the outside 11 and bubble radius r, namely that the minimum required overheating $T-T\infty$ decreases with an increase in bubble radius r, it becomes clear that the heat transfer is greatly increased due to microstructure 7 not only because of the increase in the size of the heat transfer surface but also because of the physical laws involved in the formation of bubbles as described above. According to FIG. 16, T denotes the temperature inside of bubbles 12, 13, 14, and $T\infty$ denotes the temperature in the vapor space at a greater distance therefrom.

The same thing is true accordingly in cooling processes for film condensation. To illustrate the effect of capillary pressure according to equation II which is described in the introduction to the description, let us assume a pin-shaped projection 6 which is coated with a film of condensate. In the case of a diameter-like width w of 20 $\mu$m=2r=D and a surface tension $\sigma$=10 mN/m, this yields $\Delta p=L\times10^3$=2,000 Pa. Furthermore, if a length L of the pin-shaped projection 6 of 1 mm is assumed, then the driving pressure gradient in the condensate film in this case is $\Delta p/L=2\times10^6$ Pa/m, which greatly exceeds the corresponding values in the area of the conventional single-phase flows.

Figure 17:
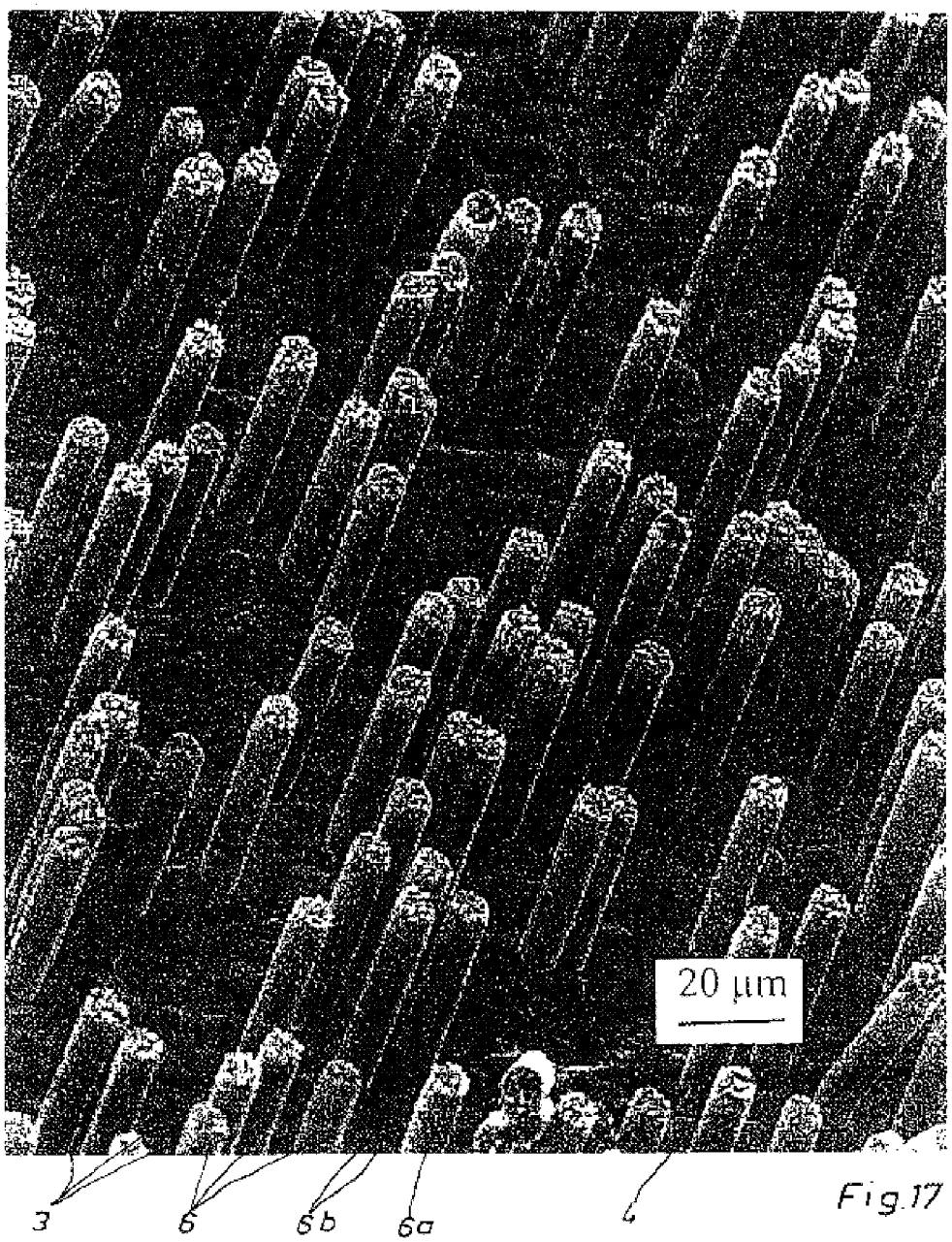
Figure 18:
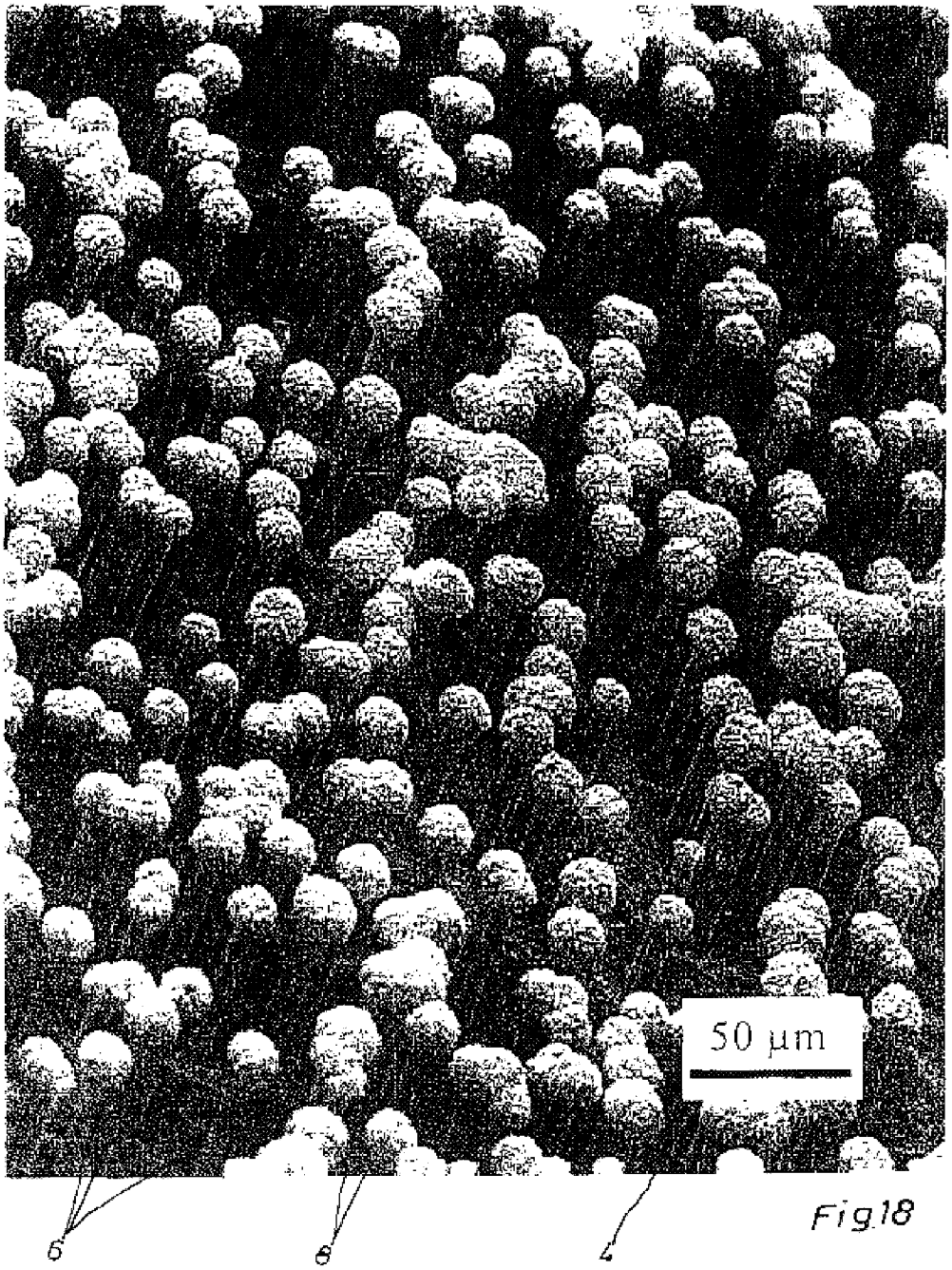
FIG. 18 a perspective photographic view of a partial detail of a body with a microstructure in the form of pin-shaped projections whose free end has a mushroom shape, projecting out of the base surface of the body and FIG. 19 a view of FIG. 18 magnified approximately fivefold.
Figure 19:
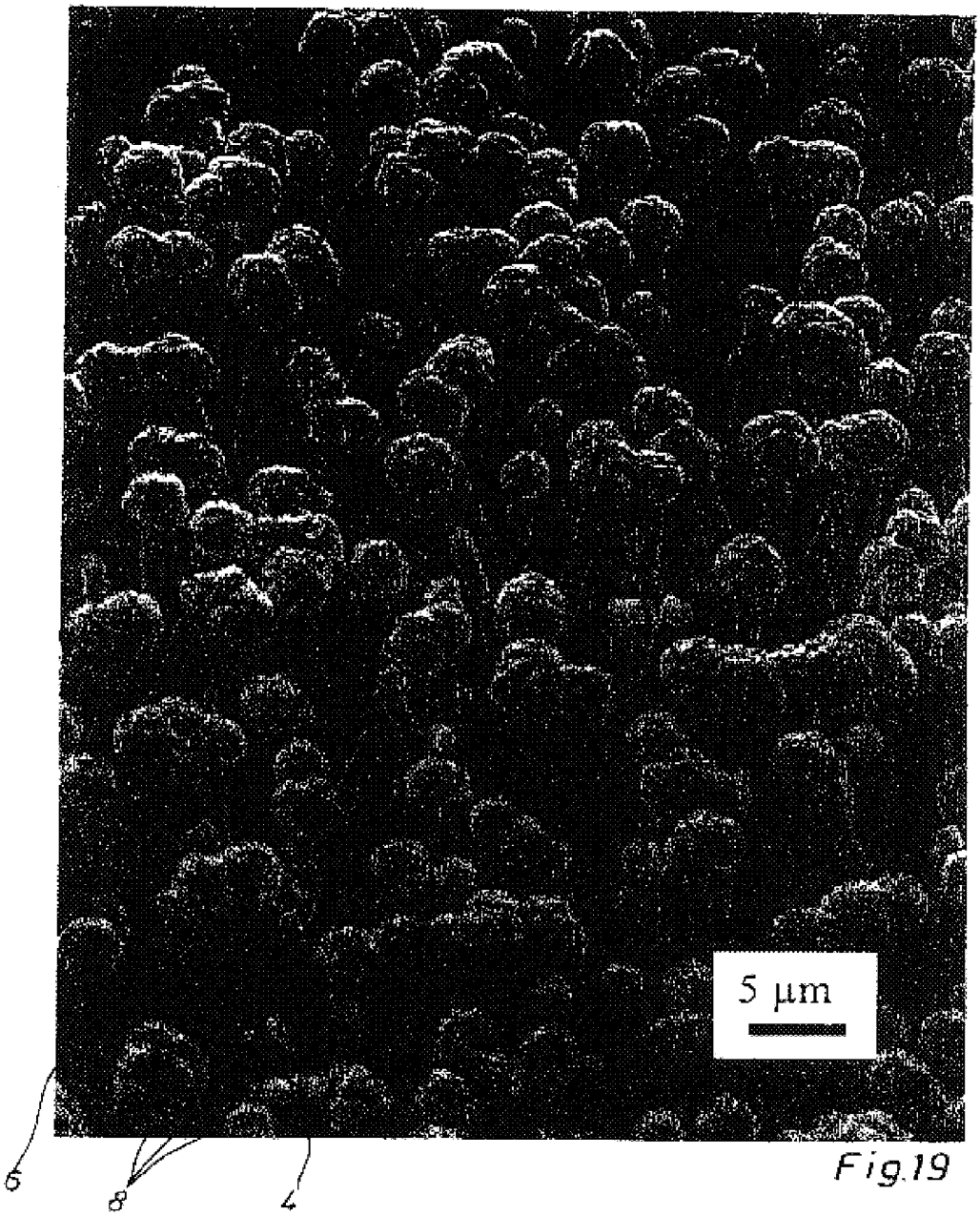

FIGS. 17 through 19 shows a heat transfer surface 3 with pin-shaped projections 6 in a stochastic order on a body 4, where the length scale for a distance of 20 $\mu$m has been superimposed. This shows clearly the roughness of the pin-shaped projections 6 on their free end and on their cylindrical surface 6*b*.

FIGS. 18 and 19 show a heat transfer surface 3 with pin-shaped projections 6 in a stochastic order, their free ends having a mushroom shape 8. The respective length scale of 50 $\mu$m and 5 $\mu$m is superimposed in the drawing. In all of FIGS. 17 through 19, it can be seen clearly that the projections 6 in the embodiments illustrated here are applied in the form of ordered microstructures 7 and they have a pin shape, which extends with its longitudinal axis 6*c* approximately perpendicular to the base surface 3*a* (see FIGS. 5 through 12). It is self-evident that the projections 6 may cover the base surface 3*a* entirely or partially, depending on the design of the ion track membrane 1.

In nucleate boiling, the porosity of the microstructure 7, which is evident in FIGS. 17 through 19, has a decisive effect on the heat transfer.

Application of the production process described above makes it possible to correlate the number of pin-shaped projections 6 per unit of area and the arrangement of the pin-shaped projections 6 and thus the porosity of the microstructure 7 to the conditions of nucleate boiling in a stochastic although ordered manner, taking into account the etching regimen, by varying the density of the bombarding ions on polymer membrane 1. Consequently, optimum conditions for nucleate boiling can be achieved through the design of the heat transfer surface 3 in the micro range, which is not possible with any mechanical machining methods.

In the area of condensation, it is possible to regenerate capillary structures after the galvanization method described above, so that these capillary structures ensure the effect of surface tension □ and promote heat transport on the condensate surface.

| List of Reference Notation | |
|---|---|
| Polymer film/ion track membrane | 1 |
| Surface of ion track membrane 1 | 1a |
| Micropores | 2 |
| Total heat transfer surface | 3 |
| Base surface | 3a |
| Tubular and plate-like body | 4 |
| Pore surface | 5 |
| Pin-shaped projections | 6 |
| Tips of projections 6 | 6a |
| Outside surface of projections 6 | 6b |
| Longitudinal axis of projections 6 | 6c |
| Microstructure | 7 |
| Mushroom shape of the free ends of projections 6 | 8 |
| Partial sections in the form of truncated cones of projections 6 | 9 |
| Inside of tubular body 4 | 10 |
| Outside of tubular body 4 | 11 |
| Bubbles of different sizes | 12, 13, 14 |
| Location of breakaway of the bubble | 15 |
| Nucleation seed of a bubble | 16 |
| Beginning of tubular body 4 | A |
| End of tubular body 4 | E |
| Thickness of polymer film 1 | D |
| Thickness of pin-shaped projections 6 | d |
| Outside and inside diameter of tubular body 4 | $D_a$, $D_i$ |
| Angle of inclination of pin-shaped projections 6 to base surface 3a | α |
| Length of projections 6 | L |
| Bubble radius | r |
| Temperatures | T, $T_0$, $T_1$, T∞ |
| Width of micropores 2 | w |
| Clearance between projections 6 | W |

What is claim is:

1. A heat transfer surface on tubular or plate-like bodies having a microstructure of projections which protrude out of the base surface and are galvanized onto the base surface with a minimum height of 10 μm, characterized in that the base surface (3*a*) is partially or entirely covered with projections (6); these projections (6) are applied in the form of ordered microstructures (7) and have a pin shape, extending with their longitudinal axis (6*c*) either perpendicular to the base surface (3*a*) or at an angle (α) between 30° and 90°, wherein the number of projections per unit of area is selected as a function of the thickness (d) of the pin-shaped projections (6) and is between 100 μm and 0.2 μm for a number between $10^2/cm^2$ and $10^8/cm^2$.

2. A heat transfer surface on tubular or plate-like bodies having a microstructure of projections which protrude out of the base surface and are generated by a galvanic process on the base surface with a minimum height of 10 μm, characterized in that the base surface (3*a*) is partially or entirely covered with projections (6); these projections (6) are applied in the form of ordered microstructures (7) and have a pin shape, extending with their longitudinal axis (6*c*) either perpendicular to the base surface (3*a*) or at an angle (α) between 30° and 900°.

3. The heat transfer surface according to claim 1, characterized in that the length (L) of the pin-shaped projections (6) on one and the same heat transfer surface (3) is constant.

4. The heat transfer surface according to claim 1, characterized in that the length (L) of the pin-shaped projections (6) is between 10 μm and 195 μm, depending on the size and specific function of the heat transfer surface (3).

5. The heat transfer surface according to claim 1, characterized in that the outside configuration of the pin-shaped projections (6) is the same on one and the same heat transfer surface (3).

6. The heat transfer surface according to claim 1, characterized in that the clearance (W) between the pin-shaped projections (6) is regular on one and the same heat transfer surface (3).

7. The heat transfer surface according to claim 1, characterized in that the clearance (W) between the pin-shaped projections (6) is between 0.6 μm and 1,000 μm, depending on the desired heat transfer surface (3).

8. The heat transfer surface according to claim 1, characterized in that the pin-shaped projections (6) are in the shape of a cylindrical column.

9. The heat transfer surface according to claim 1, characterized in that in the pin-shaped projections (6) are designed as cones or truncated cones.

10. The heat transfer surface according to claim 1, characterized in that the pin-shaped projections (6) are provided with the shape of several truncated cones (9) stacked together.

11. The heat transfer surface according to claim 1, characterized in that the pin-shaped projections (6) are provided with a cylindrical stand whose free end has a mushroom shape (8).

12. The heat transfer surface according to claim 1, characterized in that the pin-shaped projections (6) form a cylindrical stand whose free end is provided with a spherical or partially spherical shape.

13. The heat transfer surface according to claim 1, characterized in that a tubular body (4) provided with the pin-shaped projections (6) has an outside diameter ($D_a$) or an inside diameter ($D_i$) of at least 2 mm.

14. The heat transfer surface according to claim 1, characterized in that the pin-shaped projections (6) can be produced from any materials that can be deposited galvanically.

15. A method of producing a heat transfer surface on tubular or plate-like bodies having a microstructure protruding above a base surface with a minimum height of 10 μm consisting of projections galvanized onto the base, where the base surface is covered with a plastic film and is galvanized according to claims 1 through 14, characterized in that a polymer membrane (1) provided with micropores (2) is applied to the base surface (3) as a plastic film covering the entire area and in the subsequent galvanization process, the body (4) carrying the base surface (3*a*) is connected to serve as one of the electrodes, and after reaching the desired length and shape of the pin-shaped projections (6) which form the micropores (2), the galvanization process is interrupted and then the polymer membrane (1) removed.

16. The method according to claim 15, characterized in that an ion track membrane also known as a nuclear track filter is used as the polymer membrane (1).

17. The method according to claim 15, characterized in that the micropores (2) are formed in the polymer membrane (1) by ion bombardment and in a subsequent etching process using an alkaline solution.

* * * * *